US005633475A

United States Patent [19]

Chawla

[11] Patent Number: 5,633,475

[45] Date of Patent: May 27, 1997

[54] CIRCULATION SHAPED CHARGE

[75] Inventor: Manmohan S. Chawla, Houston, Tex.

[73] Assignee: Western Atlas International, Inc., Houston, Tex.

[21] Appl. No.: 613,128

[22] Filed: Mar. 8, 1996

[51] Int. Cl.[6] ..... F42B 1/02; F42B 12/10

[52] U.S. Cl. ..... 102/306; 102/476; 102/501; 175/4.5; 175/4.57

[58] Field of Search ..... 102/306–310, 102/438, 430, 439, 473, 489, 491–497, 476, 501; 89/1.15; 175/4.5, 4.57, 4.6

[56] References Cited

U.S. PATENT DOCUMENTS

| | | | |
|---|---|---|---|
| 2,797,892 | 7/1957 | Ryan | 102/307 |
| 2,831,429 | 4/1958 | Moore | 102/307 |
| 3,003,556 | 10/1961 | McGehee | 175/4.57 |
| 3,016,014 | 1/1962 | Lebourg | 89/1.15 |
| 3,224,368 | 12/1965 | House | 102/306 |
| 3,862,600 | 1/1975 | Tocco | 102/438 |
| 4,312,273 | 1/1982 | Camp | 102/310 |
| 4,421,032 | 12/1983 | Rudolf et al. | 102/307 |

FOREIGN PATENT DOCUMENTS

| | | | |
|---|---|---|---|
| 437992 | 7/1991 | European Pat. Off. | 102/306 |
| 1051407 | 12/1966 | United Kingdom | 102/476 |

*Primary Examiner*—Harold J. Tudor
*Attorney, Agent, or Firm*—Alan J. Atkinson

[57] ABSTRACT

An apparatus for generating a large perforation in a target such as a wellbore casing. A recess in a housing has a closed end and an open end facing the target. A shaped liner in the recess has an apex facing the recess open end, and has a base end facing the closed end of the recess. The shaped liner defines an interior volume filled with explosive material. The explosive material is detonated and expands the liner against the recess wall and forms a perforating jet which moves toward the recess open end. If the recess open end is circular, the perforating jet exits the recess as an annular jet which impacts the target and cuts a plug section from the target. The penetrating power of the jet is confined to the annular cutting area instead of being focused into a conventional jet shape. Multiple shaped liners can be placed in the recess, and the shape of the perforating jet can be modified by the liner shape and recess dimensions.

18 Claims, 2 Drawing Sheets

CIRCULATION SHAPED CHARGE

BACKGROUND OF THE INVENTION

The present invention relates to the field of lined explosive charges for perforating targets. More particularly, the present invention relates to an apparatus for generating a perforating jet which can produce a large hole in a target.

The invention is particularly useful in the field of downhole well perforation. Well casing is typically installed in boreholes drilled into subsurface geologic formations. The well casing prevents uncontrolled migration of subsurface fluids between different well zones and provides a conduit for production tubing in the well. The well casing also facilitates the running and installation of production tools in the well.

To produce reservoir fluids such as hydrocarbons from a subsurface geologic formation, the well casing is perforated by high velocity jets from perforating gun shaped charges. A firing head in the perforating gun detonates a primary explosive and ignites a booster charge connected to a primer or detonator cord. The detonator cord transmits a detonation wave to each shaped charge.

In a conventional shaped charge, booster charges within each shaped charge activate explosive material which collapse a shaped liner about a cavity. The collapsing liner generates a high velocity jet for penetrating the well casing and the surrounding geologic formations. The jet properties depend on the charge shape, released energy, and the liner mass and composition. Such jets perforate the well casing and establish a flow path for the reservoir fluids from the subsurface geologic formation to the interior of the well casing. Such flow path can also permit solid particles and chemicals to be pumped from the casing interior into the geologic formation during gravel packing operations.

Conventional shaped charges generate relatively small perforations in a well casing. In certain well completion operations such as gravel packing, large diameter well perforations are desirable to facilitate the rapid placement of the solid particles. Conventional perforations are formed with high velocity shaped charge jets or bullets, however the entry size of the resulting perforations is only slightly larger than the perforator diameter.

A need exists for an apparatus that can create large diameter perforations in well casing and other selected targets. Such an apparatus must remove a large target surface area before the energy of the perforating jet is expended. In addition, the apparatus should be capable of generating large perforations without damaging other downhole well components.

SUMMARY OF THE INVENTION

The invention provides an apparatus actuatable by a detonator to perforate a target. The apparatus comprises a housing and a recess, formed by an inner housing surface, and having an open end and a closed end within the housing. A shaped liner is positioned within the recess. The shaped liner has a base end facing the recess closed end and has an apex facing the open end of the recess. The liner defines an interior volume between the base end and apex which contains an explosive material. The detonator activates the explosive material to expand the liner toward the inner housing surface to form an annular jet which exits the recess open end.

In different embodiments of the invention, the inner housing surface can be cylindrical, frustoconical, or elliptical, and the perforating jet can comprise an annular jet for impacting the target. The target can comprise a tubular wall such as a well casing, and a second tubular wall can be positioned behind the first tubular wall so that the perforating jet perforates the first tubular wall without perforating the second tubular wall. The liner can be formed with a metallic material, and a second liner can be positioned within the recess so that an apex of the second liner faces the recess open end.

DESCRIPTION OF THE PREFERRED EMBODIMENTS

The present invention provides a unique apparatus for generating a large perforation in a target material. As is known in the art, conventional shaped charges ignite an explosive material to collapse a liner material about a cavity defined by the liner. The collapsing liner generates a high velocity jet traveling in a direction coincident with the liner cavity axis. The penetration width of a conventional high velocity jet depends on the diameter of the jet and the energy dissipated radially as such jet penetrates the target material. Consequently, the radial diameter penetratable by a conventional shaped charge jet is limited.

Figure 1:
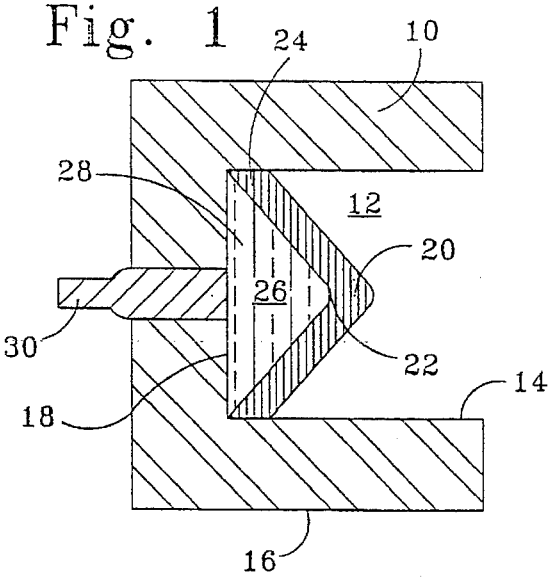
FIG. 1 illustrates an elevational, section view of a shaped liner within a charge case.

The present invention significantly improves conventional large hole penetration capability by creating a substantially larger hole in a target. Referring to FIG. 1, charge case or housing 10 defines a recessed cavity 12 having open end 14, housing wall 16, and closed end 18. If the cavity 12 of housing 10 has a parabolic or elliptical shape, wall 16 and closed end 18 are collectively defined by a continuous curved surface. Liner 20 forms a geometric figure having liner apex 22 and liner base 24. Liner 20 is positioned within cavity 12 so that liner apex 22 faces housing open end 14. Liner base end 24 faces toward closed end 18. Liner 20 defines interior volume 26 between base end 24 and liner apex 22. High explosive material 28 is positioned within interior volume 26.

Figure 2:
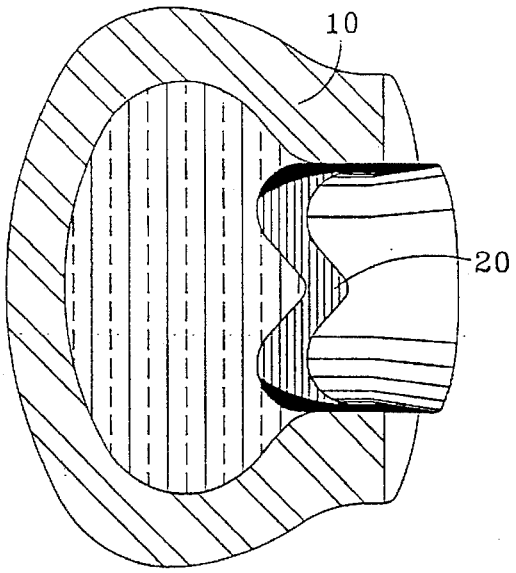
FIG. 2 illustrates liner expansion as the jet is formed.

Detonator 30 comprises a primer or detonator cord suitable for igniting high explosive material 28 to generate a detonation wave. Such detonation wave expands and projects liner 20 against housing wall 16 to form a jet at the intersection of liner 20 and housing wall 16 as shown in FIG. 2. As this intersection point moves forward towards open end 14, the hollow, peripherally shaped jet also moves in such direction consistent with the law of momentum conservation. The jet exits housing 10 at high velocity and is directed toward the selected target. Although liner 20 is preferably metallic, liner 20 can be formed with any material suitable for forming a high velocity perforating jet.

Figure 3:
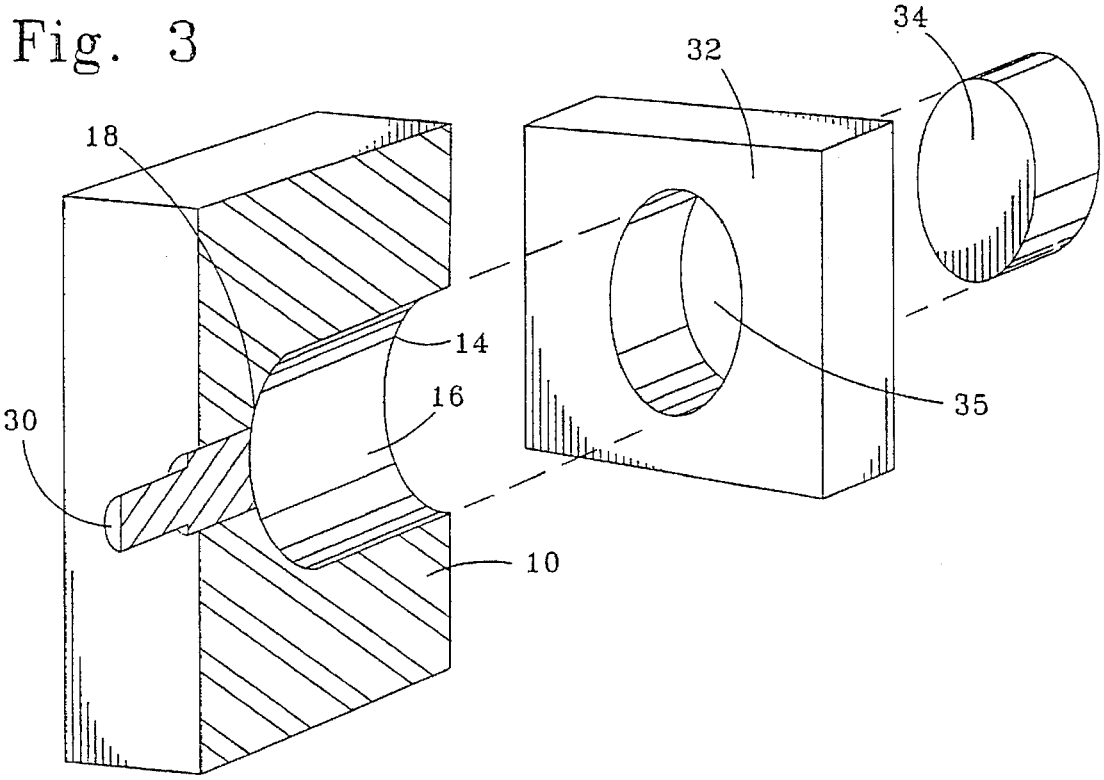
FIG. 3 illustrates an elevational, partial sectional view of a target after a shaped charge has been detonated.

FIG. 3 illustrates the penetration of a jet generated within housing 10 where wall 16 is cylindrical. The resulting annular jet impacts target 32 and penetrates the material of target 32 through an annular path. Such jet penetration removes plug or cutout 34 from target 32 and forms window 35. By refocusing the jet penetrating energy on the circumference instead of on the center mass of cutout 34, shallower penetration into target 32 is achieved. However, a larger surface area of target 32 is removed than is possible with conventional shaped charge technology.

Figure 4:
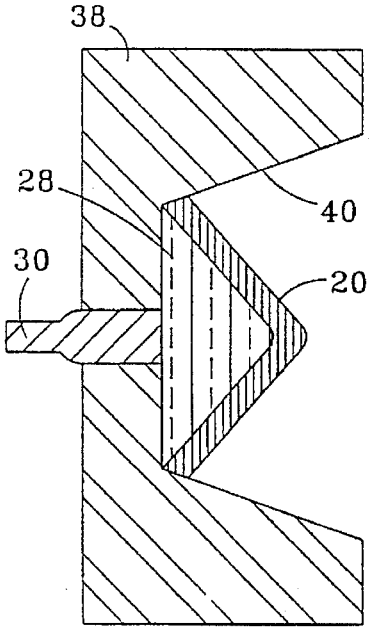
FIG. 4 illustrates a frustoconical housing for guiding a perforating jet generated by explosive material and a liner.

FIG. 4 illustrates an alternative embodiment of the invention for housing 38 wherein housing wall 40 is frustoconical instead of cylindrical. Although this embodiment further permits increases in the size of the target cutout generated by the perforating jet, the resulting radial jet expansion quickly dissipates the energy within the jet. Consequently, this embodiment of the invention may be useful in applications where the target standoff from housing 38 is small and the target is relatively thin.

Although FIGS. 3 and 4 illustrate cylindrical and frustoconical shaped recess wall surfaces for containing and shaping a perforating jet, other wall surface shapes are possible. For example, the recess wall surface can be elliptical, rectangular, or irregular in shape. The present invention provides for the shape of the perforating jet periphery to be selected according to the desired application, and provides substantial flexibility by providing a "cookie cutter" shaped perforating jet. The wall thickness of housing 38 may be sufficiently strong to resist fragmentation. Alternatively, the wall thickness of housing 38 may be sufficiently nominal to permit fragmentation of the housing wall after jet formation takes place.

Figure 5:
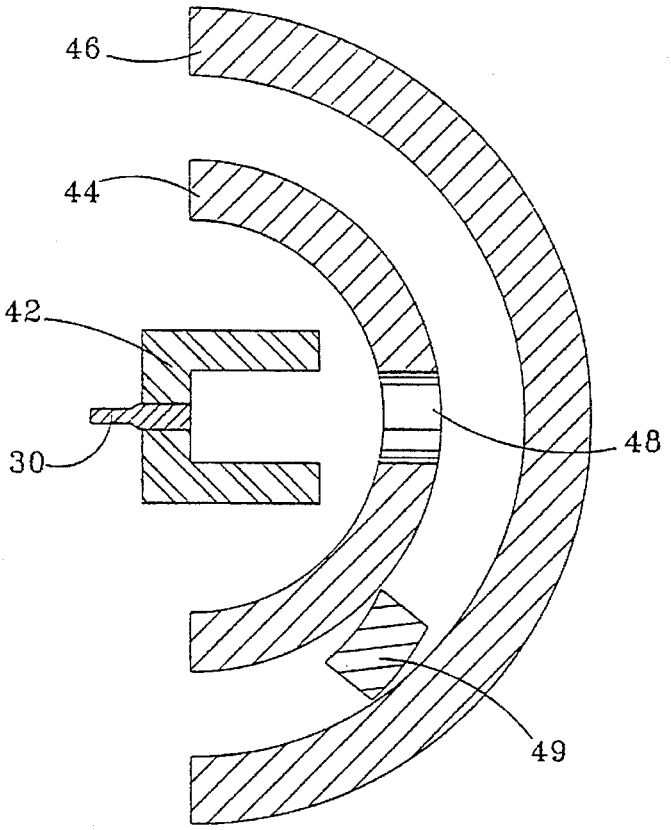
FIG. 5 illustrates concentric tubular walls wherein the interior tubular wall has been perforated.

FIG. 5 illustrates an embodiment of the invention for perforating concentric tubulars such as a casing or pipe. Charge 42 is positioned within target pipe 44, which is positioned within outer pipe 46. As shown in FIG. 5, charge 42 has been detonated to generate an annular perforating jet for creating window 48 in target pipe 44. The resulting cutout 50 can be removed or can be shunted aside to open window 48 to fluid flow. Because the energy of the perforating jet is substantially dissipated within target pipe 44, outer pipe 46 is not penetrated. Similarly, the invention can be used to perforate other targets without disturbing other elements or rock formations behind the initial target. This feature of the invention is useful because a well casing can be perforated without damaging frangible rock behind the well casing.

Figure 6:
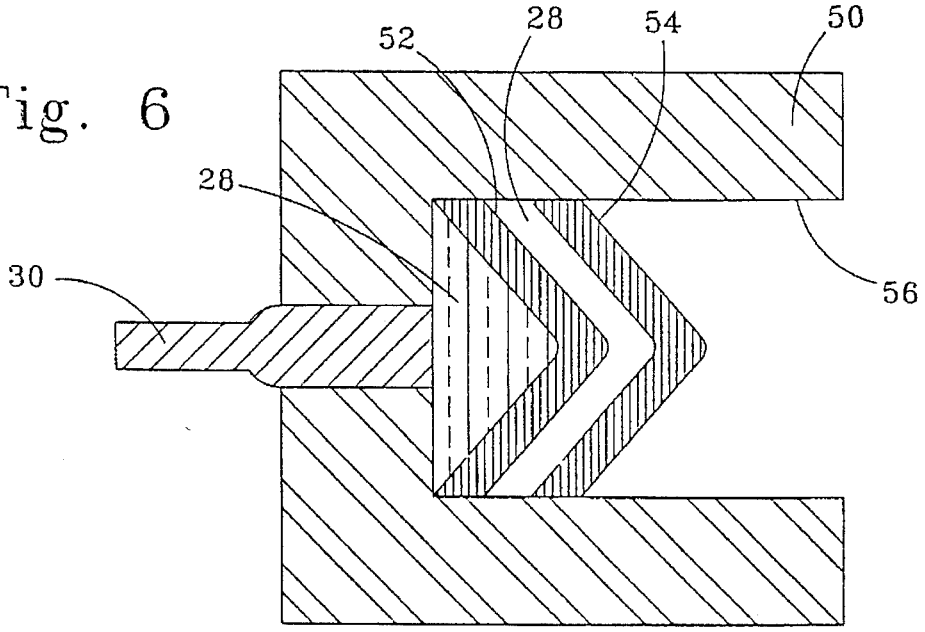
FIG. 6 illustrates one embodiment of the invention wherein two shaped charge liners are positioned within a housing recess.

FIG. 6 illustrates another embodiment of the invention wherein multiple liners are positioned within housing 50 to generate distinct perforating jets or to generate a perforating jet having a modified profile. First liner 52 and second liner 54 are positioned within housing 50 in a cascading fashion so that the apex of each liner faces the open end of the recess in housing 50. Liners 52 and 54 can be separated by a thin layer of explosive material 28 or air. When detonator 30 initiates a shock wave in high explosive material 28, liner 52 and liner 54 each collapse toward housing wall 56. Wall 56 limits radial movement of the penetrating jets and directs the penetrating jets toward the target to create a cutout as previously described. The combination of perforating jets produced from liners 52 and 54 is particularly useful in penetrating relatively thick targets such as well casing.

Although the invention has been described in terms of certain preferred embodiments, it will be apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. An apparatus actuatable by a detonator to perforate a target, comprising:

a housing;

a recess defined by an inner housing surface within said housing, wherein said recess has an open end and a closed end;

a shaped liner positioned within said recess, wherein said liner has a base end facing said recess closed end and has an apex facing the open end of said recess, and wherein said liner defines an interior volume between said base end and said apex and defines an exterior volume between said liner and said inner housing surface; and an explosive material, within said liner interior volume, which is activatable by the detonator to expand said liner through said exterior volume and against said inner housing surface to form a peripheral target perforating jet which exits the open end of said recess.

2. An apparatus as recited in claim 1, wherein the open end of said recess is circular in cross section.

3. An apparatus as recited in claim 1, wherein said inner housing surface is substantially cylindrical.

4. An apparatus as recited in claim 1, wherein said liner is metallic.

5. An apparatus as recited in claim 1, wherein said inner housing surface is substantially frustoconical.

6. An apparatus as recited in claim 1, further comprising a second shaped liner within said recess, wherein said second shaped liner has an apex facing the open end of said recess.

7. An apparatus as recited in claim 1, wherein the target comprises a first target element and a second target element behind said first target element, and wherein said shaped liner and explosive material are configured to generate a jet for perforating the first target element without perforating the second target element.

8. An apparatus as recited in claim 1, wherein said housing is sufficiently strong to avoid fragmentation as said liner impacts said inner housing surface.

9. An apparatus actuatable by a detonator to perforate a tubular wall in a wellbore, comprising:

a housing;

a recess-defined by an inner housing surface within said housing, wherein said recess has a closed end and an open end facing the tubular wall;

a metallic liner positioned within said recess, wherein said liner has a base end facing said recess closed end and has an apex facing the open end of said recess, and wherein said liner defines an interior volume between said base end and said apex and defines an exterior volume between said liner and said inner housing surface; and an explosive material, within said liner interior volume, which is activatable by the detonator to expand said liner through said exterior volume and against said inner housing surface to generate a peripheral perforating jet which exits said recess open end and perforates the tubular wall.

10. An apparatus as recited in claim 9, wherein the open end of said recess is circular in cross section.

11. An apparatus as recited in claim 9, wherein said inner housing surface is substantially cylindrical.

12. An apparatus as recited in claim 9, wherein said shaped liner and explosive material are configured to generate a jet for forming an annular perforation in the tubular wall.

13. An apparatus as recited in claim 9, further comprising a second metallic liner within said recess, wherein said second shaped liner has an apex facing the open end of said recess.

14. An apparatus as recited in claim 13, further comprising a void filled with air between said first metallic liner and said second metallic liner.

15. An apparatus as recited in claim 9, further comprising a second tubular wall behind said tubular wall, wherein said shaped liner and explosive material generate a jet for perforating the first tubular wall without perforating the second tubular wall.

16. An apparatus actuatable by a detonator to create a large perforation in a tubular well located in a wellbore, comprising:

a housing;

a recess defined by a cylindrical surface within said housing and having a closed end and a circular open end facing the tubular wall;

a metallic liner positioned within said recess, wherein said liner has a base end facing said recess closed end and has an apex facing the open end of said recess, and wherein said liner defines an interior volume between said base end and said apex and defines an exterior volume between said liner and said cylindrical surface; and an explosive material, within said liner interior volume, which is activatable by the detonator to expand said liner through said exterior volume and against said housing cylindrical surface to form an annular jet for exiting said circular open end of said recess and for perforating the tubular wall.

17. An apparatus as recited in claim 16, further comprising a second tubular wall behind said tubular wall, wherein said shaped liner and explosive material are configured to generate an annular jet for perforating the tubular wall without perforating the second tubular wall.

18. An apparatus as recited in claim 16, further comprising a second metallic liner within said recess, wherein said second metallic liner has an apex facing the open end of said recess.

* * * * *